US010119682B2

(12) United States Patent
Bao et al.

(10) Patent No.: US 10,119,682 B2
(45) Date of Patent: Nov. 6, 2018

(54) LUMINAIRE HAVING IMPROVED UNIFORMITY OF OUTPUT

(71) Applicant: PHILIPS LIGHTING HOLDING B.V., Eindhoven (NL)

(72) Inventors: Jing Bao, Shanghai (CN); Liang Zhou, Shanghai (CN); Qin Li, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/623,420

(22) Filed: Jun. 15, 2017

(65) Prior Publication Data

US 2018/0010770 A1 Jan. 11, 2018

(30) Foreign Application Priority Data

Jul. 5, 2016 (WO) ..... PCT/CN2016/088554
Sep. 6, 2016 (EP) ..... 16187432

(51) Int. Cl.
*F21V 5/04* (2006.01)
*F21V 13/04* (2006.01)
(Continued)

(52) U.S. Cl.
CPC ..... *F21V 13/04* (2013.01); *F21V 5/045* (2013.01); *F21V 7/0091* (2013.01); *F21V 7/22* (2013.01);
(Continued)

(58) Field of Classification Search
CPC .... G02B 6/002; G02B 6/0021; G02B 6/0073; G02B 6/0031; G02B 6/0036; G02B 6/0045; F21S 41/141; F21S 43/239; F21S 43/241; F21S 43/249; F21V 13/04; F21V 5/002; F21V 5/045; F21V 7/0016; F21V 7/0025
See application file for complete search history.

(56) References Cited

U.S. PATENT DOCUMENTS 6,953,271 B2 * 10/2005 Aynie ..... F21S 48/215 362/327
7,431,481 B2 * 10/2008 Stefanov ..... F21S 48/215 362/327
(Continued)

FOREIGN PATENT DOCUMENTS

EP 3015761 A1 5/2016
JP 2012104476 A 5/2012
(Continued)

*Primary Examiner* — Hargobind S Sawhney

(57) ABSTRACT

The invention provides a luminaire comprising an optical element configured to spread light uniformly across a full visible face of the luminaire. The optical element comprises a central region and an outer peripheral region, each configured to receive light emitted by a light source arrangement and to direct this light out through a respective region of the light exit area of the luminaire. The central region receives light through a central transmissive surface portion which partially bounds it across its top. A further reflective tapered portion of the central region acts to reflect light incident at either of its two opposing sides, and provides a mixing function both within the central region of the optical element and within an inner compartment of the luminaire which extends between the optical element and the housing.

15 Claims, 13 Drawing Sheets

(51) Int. Cl.

| | |
|---|---|
| ***F21V 7/00*** | (2006.01) |
| ***F21V 7/22*** | (2018.01) |
| *F21Y 103/10* | (2016.01) |
| *F21Y 103/33* | (2016.01) |
| *F21Y 115/10* | (2016.01) |

(52) U.S. Cl.
CPC ..... *F21Y 2103/10* (2016.08); *F21Y 2103/33* (2016.08); *F21Y 2115/10* (2016.08)

(56) References Cited

U.S. PATENT DOCUMENTS

| | | | | |
|---|---|---|---|---|
| 8,770,821 | B2 | 7/2014 | Ijzerman et al. | |
| 8,979,320 | B1 | 3/2015 | McDermott | |
| 9,366,396 | B2 * | 6/2016 | Yuan | F21K 9/52 |
| 9,645,303 | B2 * | 5/2017 | Tarsa | G02B 6/0078 |
| 9,732,938 | B2 * | 8/2017 | Morgan | H01L 31/0525 |
| 2013/0279198 | A1 | 10/2013 | Lin et al. | |
| 2016/0131331 | A1 * | 5/2016 | Parker | G02B 6/0001 362/311.02 |

FOREIGN PATENT DOCUMENTS

| | | | | |
|---|---|---|---|---|
| TW | 201237320 | A | 9/2012 | |
| WO | 2013058014 | A1 | 4/2013 | |
| WO | WO 2014091711 | A1 * | 6/2014 | F21S 8/04 |

* cited by examiner

LUMINAIRE HAVING IMPROVED UNIFORMITY OF OUTPUT

FIELD OF THE INVENTION

This invention relates to a luminaire, in particular to a luminaire for panel lighting applications.

BACKGROUND OF THE INVENTION

Luminaires offering thin form factor and wide area output are highly useful and widely implemented across a range of different lighting applications. One common application is their use for ceiling lighting, for example in offices and other commercial or public spaces. Here, important design considerations include both the need to generate an output offering low glare, and also the need to provide a luminaire achieving uniform illuminance of visible output surfaces (for aesthetic as well as practical reasons).

Currently, thin form factor and low-glare output can be achieved in state of the art devices, but at the cost of a luminous output which does not cover the entirety of visible output surfaces. This is demonstrated in FIGS. 1 and 2 which illustrate cross-sectional and 'underside' views respectively of a state of the art luminaire 12, achieving thin architecture and low-glare.

As shown in FIG. 1, in order to achieve low glare, the luminaire 12 comprises a central reflective element 18 which specularly reflects incident light emitted from the light sources 14 onto the reflective inner surfaces of a housing 20. The central reflective element 18 provides a light mixing function within the interior of the housing and limits the range of output angles at which light may be emitted from the device. However, as shown in FIG. 2, the presence of the central reflective element 18 means that light is output from the device only through outer annular output window 16, leaving a dark circular shadow at the centre of the visible output surface.

A central dark region such as this is avoided in alternative state of the art solutions, whilst still maintaining low-glare. However, this comes at the cost of thicker form factor. One example of such a solution is illustrated in FIG. 3. In order to achieve low-glare, the provided luminaire 22 comprises a parabolic louvre 23 which limits the range of ray output angles so as not to exceed a particular shielding angle. When the louvre is viewed at angles beyond the shielding angle, the visible luminous intensity is greatly reduced, and thus any potential glare diminished or avoided.

However, such a parabolic reflector increases the depth of the provided luminaire, and hence does not provide the ideal solution for applications where thin form factor is an important concern.

Thin form factor and uniform illuminance of visible output surfaces is achievable in many further examples of state of the art devices, but typically at the cost of increased glare. Solutions may include for example the provision of a thin-panel housing comprising a set of light sources arranged directly opposite a diffusive light output window. While a diffuser will limit the worst of any glare, the direct angle at which the light sources face the transmissive output surface means that glare is still increased compared to other solutions which provide light mixing or otherwise limit angular output range.

A final possible known solution is to augment the above-mentioned arrangement with a further optical plate designed to shape the output profile of the emitted light. However, such a system which includes multiple optical elements (diffusive output window and light-output shaping element) is more complex to produce and incurs greater costs.

There is a need therefore for a luminaire capable of achieving thin form factor and low-glare, whilst also providing uniform spread of illuminance across the totality of visible light output surface(s), which may be manufactured with fewer components and at reduced cost.

SUMMARY OF THE INVENTION

The invention is defined by the claims.

According to an aspect of the invention, there is provided a luminaire, comprising:

a housing including a compartment having a reflective inner surface and an optical element comprising:

a light entry surface arrangement facing the compartment and including a central transmissive surface portion separated from a peripheral transmissive surface portion by a tapered surface portion having opposing reflective surfaces and tapering outwardly towards a light exit surface arrangement including a central stepped profile stepping toward the compartment, the central stepped profile including a transmissive roof section facing the central transmissive surface portion and one or more tapered total internal reflection sidewall sections each facing a reflective surface of the tapered surface portion, the transmissive roof section having a smaller cross-section than the central transmissive surface portion; and a light source arrangement in the compartment arranged to emit a first fraction of light onto the central transmissive surface portion and a second fraction of light onto at least one of the reflective inner surface, the tapered surface portion and the peripheral transmissive surface portion.

The solution of the present invention provides a single, thin-form optical element which extends across the totality of an output area of the luminaire. The optical element is capable of enabling both the transmission of light across the totality of its lower output surface (the light exit surface arrangement), and the effective mixing of light within the compartment above sufficient to prevent escape of light from the device at angles which would cause glare.

The included optical element achieves this by means of a central optical area which is bounded across its top by a central transmissive surface portion (which allows free transmission of light) and a tapered surface portion formed of walls which are reflective on both sides. Facing the central transmissive portion and bounding the central optical area across its base is a stepped, mesa-shaped structure formed in a central section of the the lower surface of the optical element, surrounded by a transmissive planar surface region. This central optical area delineated by the mentioned surface sections effectively defines a secondary mixing chamber (secondary to the compartment), having internal surfaces configured provide an even spread of light across a central output area of the luminaire.

The tapered surface portion provides a dual-reflectivity function, providing both a light mixing function within the compartment (i.e. the function provided by the specularly reflective central element 18 of the example illustrated in FIG. 1), and also a secondary light mixing function for light within the secondary mixing chamber referred to above. The light source arrangement is positioned such that one portion of its total light output is directed through the central transmissive surface portion (for mixing and subsequent transmission through a central region of the light output area of the luminaire) and a second portion is directed onto remaining surfaces within the compartment, for reflection onto, or direct transmission through, an outer peripheral region of optical element and of the luminaire output area.

The optical element is thus configured to provide an even spread of light across the totality of a light output area of the device, with even illuminance across both an outer peripheral transmissive region and a central region. Glare is avoided by means of the reflective outer surface of the tapered surface portion of the optical element, which mixes light within the compartment and prevents escape of light at glare-inducing angles.

According to examples, the central transmissive surface portion of the optical element may comprise one or more inclined surfaces meeting in a point facing the stepped profile. This configuration may enable more efficient capturing of the light emitted by the light sources in the direction of the central transmissive surface portion. A flat central transmissive region might increase the proportion of incident light which is reflected from, rather than transmitted through, the central transmissive surface portion, reducing the optical efficiency.

In accordance with one or more sets of embodiments, the tapered surface portion of the optical element may be concavely inflected, comprising adjoining inclined surface sections. In particular examples, said adjoining inclined surface sections may be of unequal length, such that a vertex of said inflection is located closer to a boundary with the central transmissive surface portion of the optical element than to a boundary with the peripheral transmissive surface portion.

This asymmetrically positioned inflection point may improve the uniformity or homogeneity of the luminaire light output. The particular positioning of the inflection point enables a particular combination of incline angles to be achieved for each of the respective tapered surfaces. These incline angles may ensure that a substantially even spread of light is directed across the whole of each of the central region A of the light exit surface arrangement and the peripheral region B of the light exit surface arrangement.

In examples, said peripheral transmissive surface portion of the optical element may comprise a collimating lens plate. A collimating lens may ensure that light directed onto the peripheral transmissive surface portion from any of a range of angles within the compartment is uniformly collected and transmitted from the luminaire across a common (restricted) set of output angles.

More particularly, the collimating lens plate may be a Fresnel plate, featuring for instance a micro-Fresnel structure.

According to one or more set of examples, a section of the reflective inner surface of the housing may be bow-shaped. A bow-shaped interior surface arrangement (or section) may enable a substantially even spread of reflected light across the optical element and the light exit surface arrangement.

In one or more examples, the reflective inner surface may be diffusively reflective. This may help to further prevent glare, by ensuring any locally bright spots generated through the interaction of inner reflected surfaces for example are softened or spread before projection onto the light exit surface arrangement.

In accordance with one or more sets of embodiments, the light exit surface arrangement may have a total surface area which includes a surface area opposite the central transmissive surface portion and tapered surface portion of the light entry surface arrangement, and wherein the first fraction of light emitted onto the central transmissive surface portion corresponds to a proportion of a total luminous output of the light source arrangement equal to said surface area as a proportion of the total surface area.

Such an arrangement ensures that a substantially uniform spread of light is distributed across the entire light exit surface arrangement of the optical element. As mentioned above, the central transmissive surface portion acts as a light entry window to a central optical area of the optical element, which acts to mix and subsequently emit light across a central region of the light exit surface arrangement. The light source arrangement is configured to direct a proportion of its total light output onto the central transmissive surface portion, this proportion being commensurate with the proportion of the total light exit area of the device accounted for by lower transmissive surfaces of this central optical area. The remainder of the light is directed into the compartment for mixing and subsequent transmission through the peripheral transmissive surface portion of the optical element.

According to one set of examples of the above embodiment, the light source arrangement may have a total light emitting area, and be positioned opposite to a boundary between the central transmissive surface portion and the tapered surface portion such that a first portion of said total light emitting area faces the central transmissive surface portion, said first portion corresponding to a fraction of the total light emitting area equal to said surface area opposite the central transmissive surface portion and tapered surface portion as a fraction of said total surface area.

Thus the required division of the light output between the different surface sections of the optical element is achieved by means of a careful positioning of the light source arrangement relative to a boundary between the relevant surface sections. Where LED light sources are used for instance, which naturally generate a Lambertian luminous output, the relative positioning of the light emitting area can be used to precisely determine the proportion of the total light output directed onto different of the receiving surfaces. This provides a simple means of achieving the desired effect, without the need for additional optics for instance.

In accordance with one or more sets of embodiments, the central transmissive surface portion and the tapered surface portion may be separated by a circular boundary, and the light source arrangement may comprise an annular arrangement of light sources positioned opposite to said boundary.

According to an alternative set of one or more embodiments, the central transmissive surface portion and the tapered surface portion of the optical element may be separated by a pair of parallel opposing linear boundaries, and wherein the light source arrangement comprises a plurality of rows of light sources. This arrangement provides a substantially rectangular or linear configuration.

According to either of the above examples, the peripheral transmissive surface portion may have a circular outer perimeter, or a rectangular outer perimeter.

In particular examples of any of the above described embodiments, the central transmissive surface portion of the optical element may be formed of an optical grade polymer material.

The opposing reflective surfaces of the tapered surface portion may, according to particular examples, be formed by a specularly reflective metal coating.

According to any embodiment of the invention, the light source arrangement may comprise one or more LED light sources.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire comprising an optical element configured to spread light uniformly across a full visible face of the luminaire. The optical element comprises a central region and an outer peripheral region, each configured to receive light emitted by a light source arrangement and to direct this light through a respective region of the light exit area of the luminaire. The central region receives light through a central transmissive surface portion which partially bounds the central region across its top. A further reflective tapered portion of the central region acts to reflect light incident on either side of it, and provides a mixing function both within the central region of the optical element and within an inner compartment of the luminaire which extends between the optical element and the housing.

Figure 4:
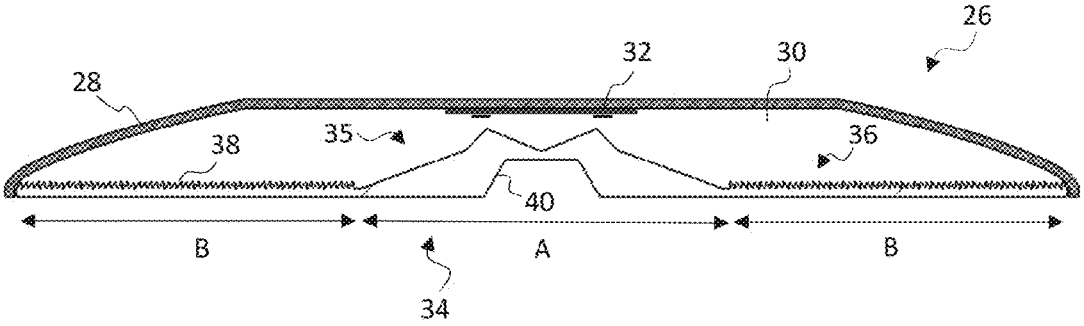
FIG. 4 shows a cross-sectional view of a first example luminaire in accordance with one or more embodiments of the invention.
Figure 5:
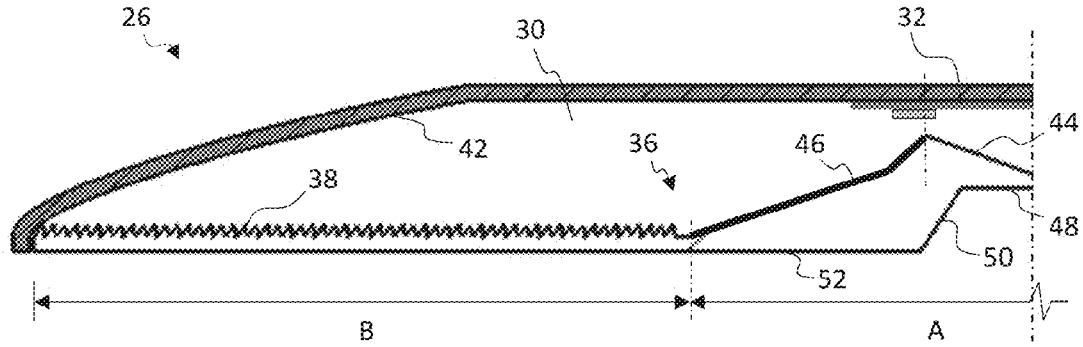
FIG. 5 shows a second cross-sectional view of the first example luminaire.

FIG. 4 schematically depicts a cross-sectional view of a first example luminaire in accordance with embodiments of the invention. FIG. 5 shows the interior of one side of the luminaire in more detail.

The luminaire 26 comprises a housing 28 having reflective inner surfaces 42, and containing a light source arrangement 32 arranged mounted to the housing. Arranged extending across an open side of the housing, said open side forming a light exit area of the luminaire, is an optical element 36. The optical element acts to delimit, in combination with the housing, an internal compartment 30 within the luminaire.

The optical element 36 is bounded by outer surfaces which include a light entry surface arrangement 35 and an opposing light exit surface arrangement 34. The light entry surface arrangement comprises a central transmissive surface portion 44 which is linked to a transmissive peripheral surface portion 38 via a tapered surface portion 46, the tapered surface portion being reflective across both its sides, e.g. specularly reflective.

As illustrated in FIGS. 4 and 5, the optical element 36 may be notionally divided into two regions: a central region, region A, and a peripheral region, region B. The optical element is assumed for the example illustrated to be symmetric about a central point, with the peripheral region B surrounding the central region A. The central region A of the optical element includes the central transmissive surface portion 44 and the (reflective) tapered surface portion 46 of the light entry surface arrangement. The central region A further includes a central stepped profile 40, and a surrounding planar transmissive surface portion 52 of the light exit surface arrangement.

These respective sections of the light exit 34 and light entry 35 surface arrangements of the optical element together delimit a central optical area within the optical element which effectively provides a secondary mixing chamber for mixing and spreading light for output across a central region A of the light exit surface arrangement. Light entering this central optical area, via the central transmissive portion 44, falls incident on surfaces of the stepped profile 40, which, through a combination of transmission and total internal reflection, acts to mix and spread light evenly across the totality of the central section A of the light exit surface arrangement. This is described in greater detail further below.

The peripheral region B of the optical element includes the transmissive peripheral surface portion of the optical element, which is adapted to collect light reflected or emitted from the reflective internal surface(s) 42 and the light source arrangement 32 respectively, for transmission through said peripheral region B.

The two regions A, B of the optical element are hence configured to together facilitate a uniform spread of light across the entire extent of the light exit surface arrangement 34.

Figure 6:
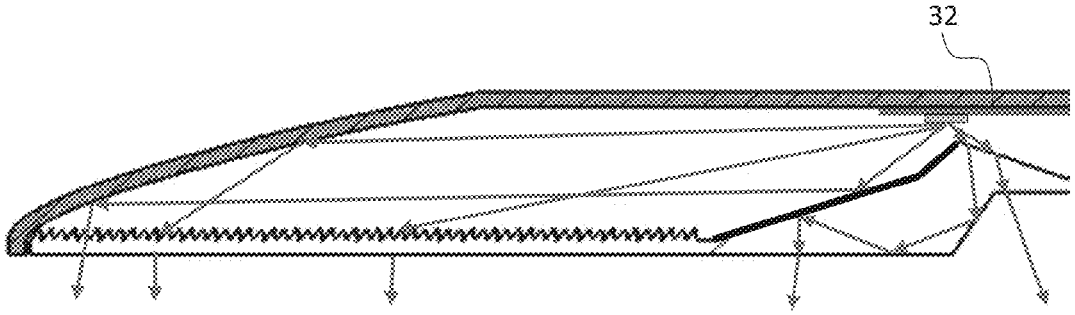
FIG. 6 shows a ray diagram schematically depicting paths of light rays through the first example luminaire.

FIG. 6 schematically illustrates ray paths of light travelling through the luminaire. As shown, a first portion of light emitted by the light source arrangement 32 is directed onto the central transmissive surface portion 44 of the light entry surface arrangement, and a second portion of light is spread across a combination of the tapered surface portion 46 of the optical element 36, the peripheral surface portion 38 of the optical element 36, and the reflective internal surface 42 of the housing.

Light directed onto the central transmissive surface portion 44 is transmitted into the interior of the central region of the optical element, which, as mentioned above, acts as an effective secondary mixing chamber to spread light across the central region of the light exit surface arrangement 34. Light received through the central transmissive surface portion is diffracted as it enters, bending toward the normal of the surface portion, and is directed onto the central stepped profile 40 of the light exit surface arrangement. The central stepped profile includes a transmissive roof section 48, arranged facing the central transmissive surface portion and having a cross-section which is smaller than that of the central transmissive surface portion, and one or more (one if the stepped profile is circularly symmetric) total internal reflection (TIR) sidewall sections 50.

Light directed onto the transmissive roof section is transmitted directly out from the optical element, and escapes from the luminaire 26. Light directed onto the one or more TIR sidewall sections 50 is reflected by TIR onto the surrounding planar transmissive surface portion 52 of the light exit surface arrangement 34 and/or onto the specularly reflective tapered surface portion 46. Light directed onto the planar transmissive surface portion 52 at an angle from the normal which exceeds a certain threshold (i.e. which is greater than the critical angle) may be re-reflected by TIR onto the tapered surface portion 46, from which it is re-reflected back downward onto the planar transmissive surface portion 52 at a more acute angle with the normal, at which it may be transmitted from the optical element.

Internal surfaces of the central region A of the optical element are hence configured to restrict emission of light through the central region of the light exit surface arrangement at angles which are too wide/shallow, and which may hence cause glare.

As mentioned, the tapered surface portion 46 of the central region A of the light entry surface arrangement is reflective across both sides. Light directed by the light source arrangement 32 onto an 'upper' facing side of this tapered surface portion is reflected into the compartment 30 toward a downwardly tapered surface section of the internal reflective surface 42 of the housing 28. From here, the light is re-reflected downward onto the transmissive peripheral portion 38 for transmission from the luminaire.

As shown, the housing may be bow-shaped, comprising a substantially flat central portion, surrounded by downwardly tapering portions on either side. This shape confers certain advantages, in particular it helps to collect the maximal amount of light from both the light source arrangement and the reflective tapered surface portion 46, for deflection downward onto the transmissive peripheral surface portion 38 of the optical element. However other suitable shapes will also be immediately apparent to the skilled person.

Light directed by the light source arrangement 32 directly onto the transmissive peripheral surface portion 38 of the optical element 36 is collected and transmitted directly through the optical element allowing it to escape from the luminaire. In the particular example of FIGS. 4-6, the transmissive peripheral region of the optical element is formed by a Fresnel lens plate (a 'micro-Fresnel' structure). The micro-Fresnel structure provides a collimation function, collecting light rays falling incident on it at a shallow angle with respect to an overall plane defined by the plate (or, equivalently, an obtuse angle with respect to the normal of this plane), and re-orienting them by TIR into a substantially more acutely angled direction (with respect to the normal).

Figure 7:
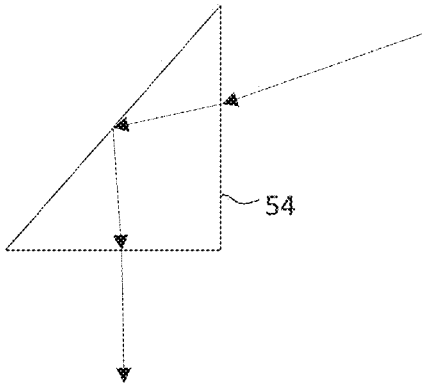
FIG. 7 schematically illustrates the path of a light ray through a micro-prism structure as comprised by optical elements included within one or more embodiments of the invention.

The micro-Fresnel structure effectively comprises a series of adjoining prism structures, each configured to receive light at a shallow angle and to internally reflect it into a more acute or 'upright' direction. FIG. 7 schematically illustrates an example micro-prism structure 54, and the path of a light ray travelling through it. As shown, light incident upon the prism structure diffracts as it enters the interior of the structure, before propagating through to fall incident at the 'hypotenuse' wall of the prism. Here it is deflected by TIR into a substantially 'upright' or 'vertical' angle (from the perspective shown in the Figures). The light then escapes through a base of the micro-pyramid structure, refracting once again as it exits.

The advantage of such a collimating structure is that the light source arrangement 32 may mounted within the compartment 30 laterally displaced with respect to the transmissive peripheral surface portion 38. This firstly allows that the light source arrangement may be positioned centrally within the compartment, thereby enabling a radially symmetric spread of light across the light exit surface arrangement (which may be optically and aesthetically preferable). This can be achieved while still ensuring all light exiting the luminaire is collected and directed outwards from the luminaire across a restricted range of output angles (therefore reducing glare). Secondly, the lateral displacement of the light source arrangement with respect to the transmissive peripheral surface portion 38 effectively hides the light sources from the direct view of observers.

According to one or more examples, the transmissive peripheral surface portion 38 may be formed of a transmissive optical grade polymer. Suitable examples include, polycarbonate, poly(methyl methacrylate), polyethylene terephthalate, although other suitable examples will be apparent to the skilled person.

According to any embodiment, the transmissive peripheral surface portion 38 may be at least partially diffusive, thereby providing a softer or generally more diffuse luminous output from the luminaire. This may be preferable for aesthetic reasons, or for reasons of reducing glare, in certain example cases.

Figure 1:
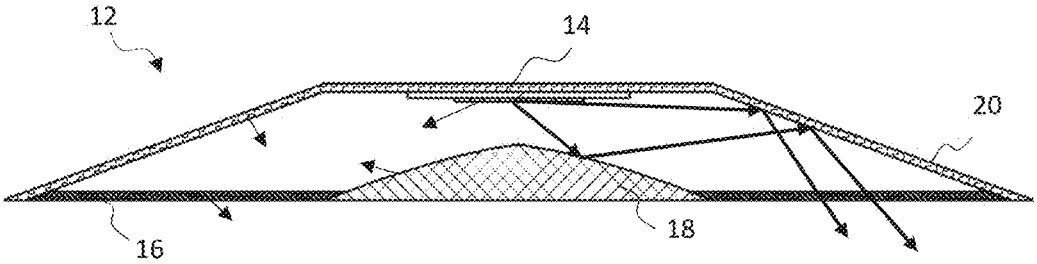
FIG. 1 shows a cross-sectional view of a first example luminaire as known in art.
Figure 2:
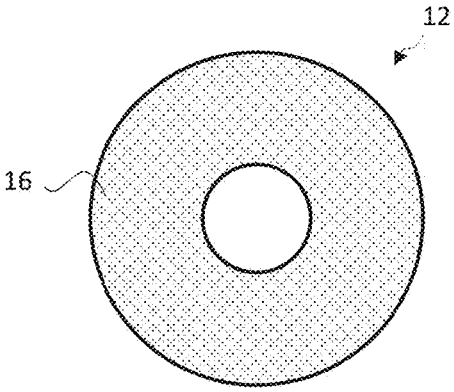
FIG. 2 shows an underside view of the first example luminaire as known in art.
Figure 3:
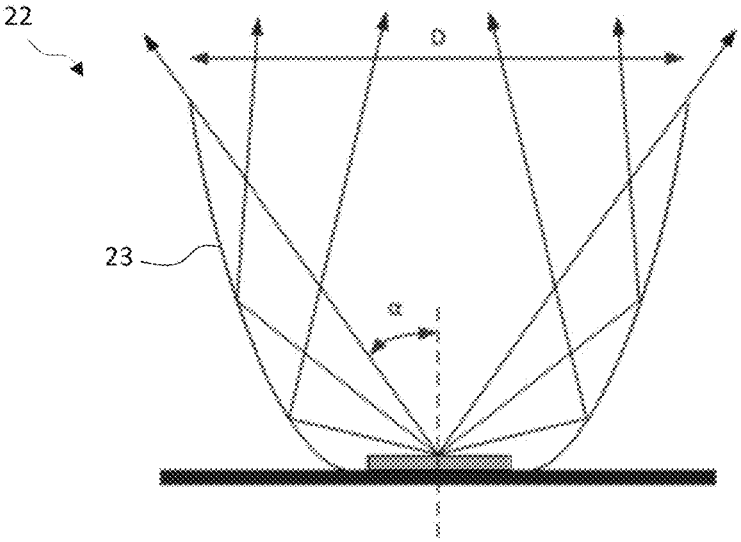
FIG. 3 shows a second example luminaire as known in art.

Although in the particular example depicted by FIGS. 3-5, the transmissive peripheral region of the optical element 38 comprises a micro-Fresnel structure, this is not essential, and in other examples, different optical elements may be used. The peripheral region may be formed of a globally planar transmissive surface, or may comprise a different form of lens or beam-shaping/directing plate, a different form of diffusive structure, or any other type of suitable structure for instance.

As mentioned above, the light source arrangement is arranged such that a first portion of its total luminous output is directed onto the central transmissive surface portion 44, and a second portion is spread across a combination of the tapered surface portion 46 of the optical element 36, the peripheral surface portion 38 of the optical element 36, and the reflective internal surface 42 of the housing. The first portion is transmitted into the central region A of the optical element and is directed out from the luminaire via the central region A of the light exit surface arrangement 34. The second portion is directed onto internal surfaces of the compartment 30 and is directed out from the luminaire via the peripheral region B of the light exit surface arrangement.

In order to ensure a uniform spread of light across the extent of the light exit surface arrangement, it is necessary to ensure that an even amount of light is distributed across both the central A and peripheral B regions of the light exit surface arrangement 34. This requires ensuring that the portion of the total luminous output directed through each of the central A and peripheral B regions of the light exit surface arrangement is proportionate to the relative surface areas of each of these regions, considered as a fraction of the total surface area of the whole light exit surface arrangement.

More precisely, where the central region A of the light exit surface arrangement has surface area $S_A$, and the peripheral region B of the light exit surface arrangement has surface area $S_B$, then the following relation may hold:

$$\frac{L_A}{L_{TOTAL}} = \frac{S_A}{S_A + S_B} \tag{1}$$

where $L_A$=luminous output directed onto the central transmissive surface portion 44 (for transmission through the central region of the light exit surface arrangement), and $L_{TOTAL}$=total luminous output produced by the light source arrangement.

Equally, the following relation should also then hold:

$$\frac{L_B}{L_{TOTAL}} = \frac{S_B}{S_A + S_B} \tag{2}$$

where $L_B$=luminous output directed onto the combination of the tapered surface portion 46 of the optical element 36, the peripheral surface portion 38 of the optical element 36, and the reflective internal surface 42 of the housing 28, where $L_{TOTAL}=L_A+L_B$.

According to one example set of embodiments, in which each of the central and peripheral regions of the optical element are circular in shape, with the central region A having radial extension $r_A$, and the peripheral region B having radial extension $r_B$, relations (1) and (2) above may be re-expressed as:

$$\frac{L_A}{L_{TOTAL}} = \frac{\pi r_A^2}{\pi(r_A + r_B)^2} \tag{3}$$

$$\frac{L_B}{L_{TOTAL}} = \frac{\pi(r_A + r_B)^2 - \pi r_A^2}{\pi(r_A + r_B)^2} \tag{4}$$

Figure 8:
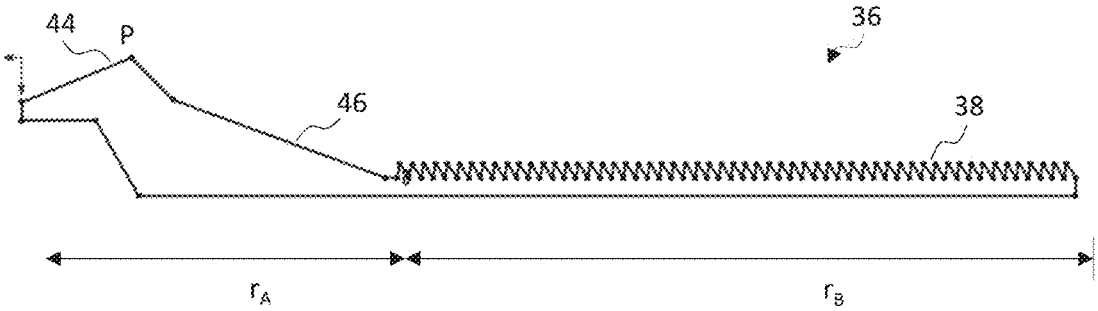
FIG. 8 shows a cross-sectional view of an optical element comprised by one or more embodiments of the invention.

By 'radial extension' is meant the extension spanned by each respective region in a radial direction, as measured from the origin of the circular optical element. These dimensions are illustrated schematically in FIG. 8 which shows a cross-sectional view of a circular optical element 36.

As mentioned above, one means of achieving the desired distribution of luminous output across the two regions A, B of the light exit surface arrangement 34 is by careful positioning of the light source arrangement 32 relative to the optical element 36, so as to ensure the correct amount of light is directed toward each region. In particular, in the case that the light source arrangement has total light emitting area $LA_{TOT}$, one may position or design the light source arrangement such that the proportion of the total light emitting area which is arranged facing the central transmissive region 44 of the light entry surface arrangement 35 is equal to the desired proportion of the total luminous output to be directed onto the central transmissive surface region (i.e. $L_A/L_{TOTAL}$)

In the present case, this may be achieved for example by arranging or designing the light source arrangement having its light emitting area(s) facing a boundary between the central transmissive portion 44 and the tapered portion 46 (this boundary labelled P in FIG. 8), wherein the proportion of the total light emitting area $LA_{TOT}$ falling on the central transmissive surface side of the boundary is equal to the desired proportion of the total luminous output required to fall on this side.

Figure 9:
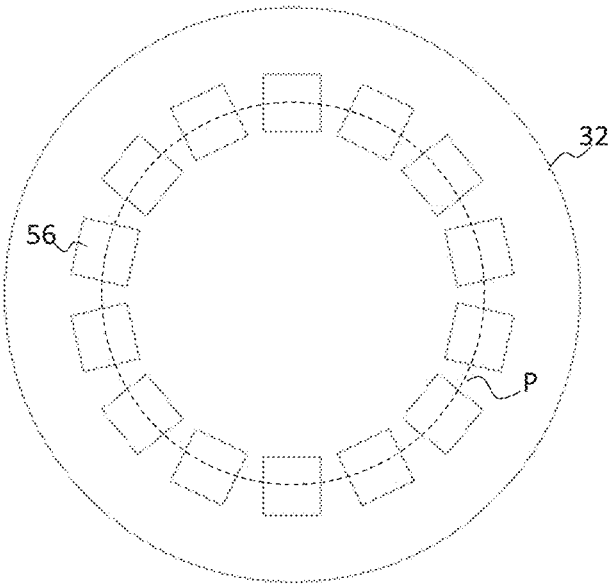
FIG. 9 shows an example light source arrangement comprising an annular array of light sources.

The arrangement is illustrated schematically in FIG. 9 which shows an exemplary location of a boundary P of an example optical element 36 as projected onto an example light source arrangement 32, arranged opposing said boundary. For the particular example illustrated, the light source arrangement is taken to comprise an annular array of light sources 56, and the optical element is assumed to comprise a central A and peripheral B region, each having a circular shape. The optical element 36 implemented in this example is schematically depicted (in scaled-down form) in FIG. 10 by way of illustration.

As illustrated in FIG. 9, one portion of the light emitting area of each light source falls inside the boundary P, and a second portion falls outside the boundary P. The portion falling inside is arranged facing the central transmissive surface portion 44, and the portion falling outside is arranged facing the tapered surface portion 46. The proportion of the total light emitting area of the entire array of light sources falling on the central transmissive surface side of boundary P should be equal to the desired proportion of the total luminous output required to fall on this side.

More precisely, where $LA_C$=portion of the light emitting area falling on the central transmissive surface side of boundary P, and $LA_T$=portion of the light emitting area falling on the tapered surface side of boundary P, then the following relation should hold:

$$\frac{LA_c}{LA_{TOT}} = \frac{L_A}{L_{TOTAL}} = \frac{S_A}{S_A + S_B} \tag{5}$$

where $LA_{TOT}$=total light emitting area of the light source arrangement, $S_A$=surface area of the central region A of the light exit surface arrangement, $S_B$=surface area of the peripheral region B of the light exit surface arrangement, $L_A$=luminous output directed onto the central transmissive surface portion 44, and $L_B$=luminous output directed onto the combination of the tapered surface portion 46 of the optical element 36, the peripheral surface portion 38 of the optical element 36, and the reflective internal surface 42 of the housing.

According to the particular set of embodiments in which the optical element is circular, then the relation may be expressed:

$$\frac{LA_c}{LA_{TOT}} = \frac{L_A}{L_{TOTAL}} = \frac{\pi r_A^2}{\pi(r_A + r_B)^2} \quad (6)$$

where each of $LA_C$, $LA_{TOT}$, $L_A$, $L_{TOTAL}$, $r_A$ and $r_B$ are as defined in relation to expressions (1)-(6) above.

According to any particular embodiment of the invention, the light source arrangement 32 may comprise a plurality of LED light sources. LEDs offer numerous advantages including high energy and optical efficiency, long life-time, low power consumption and fast switching. LED light sources may optionally be incorporated in combination with a so-called 'driver on board' (DOB) light engine, which enables a reduction in the total number of components, and therefore may improve simplicity or speed of manufacture and may reduce costs.

Additionally, use of a driver on board light engine enables embodiments of the luminaire to be directly surface mounted, without the need to drill holes through the mounting surface upon installation. This is because driver on board implementation enables luminaires to be entirely self-contained, with driver components fully incorporated within the light source arrangement 32. Additional external driving components do not therefore need to be provided and connected to the luminaire. This may significantly reduce the complexity, cost and time taken for installation (and removal or adjustment) of the luminaire.

According to one or more embodiments, electrical circuitry or components associated with driving the light source arrangement may be positioned or arranged relative to the light entry surface arrangement 35 such that these elements remain substantially or fully hidden from the view of onlookers. This may be achieved for example by positioning electrical components just outside of the light source arrangement and optically aligned with the (reflective) tapered surface portion 46. The reflective tapered surface portion may then substantially or fully hide these electrical components from view.

As discussed above, according to one particular set of embodiments, both the central region A of the optical element 36 and the peripheral region B may have a circular shape. The central region A may have a circularly symmetric cross-section, for example an annular cross-section. The peripheral region B may have a circular outer perimeter and/or an annular shape for instance. An example of such an embodiment is illustrated schematically in FIG. 10.

Figure 10:
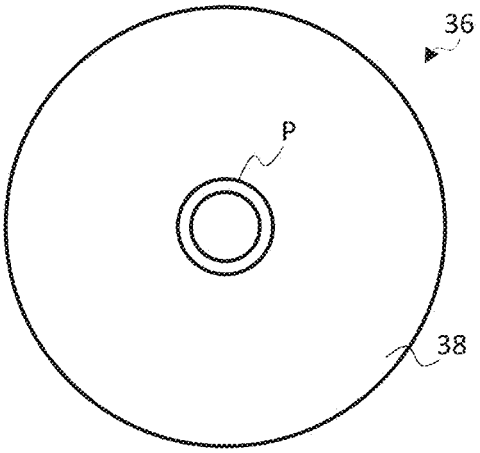
FIG. 10 shows an example optical element having a circular shape, as comprised by one or more embodiments of the invention.
Figure 11:
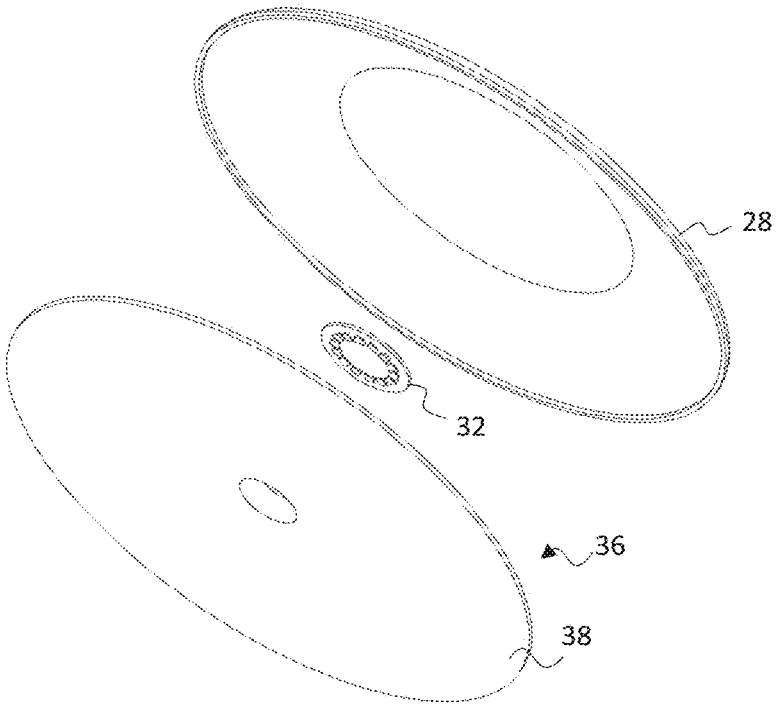
FIG. 11 shows an exploded view of an example luminaire comprising a circular optical element.

An exploded view of an example luminaire comprising the circular optical element of FIGS. 9 and 10 is shown in FIG. 11. As shown, the optical element 36 is arranged extending across the open surface of a circular housing structure 28. The circular array of light sources 32 (as illustrated in FIG. 9) is arranged opposing a central region of the optical element 36, and is mounted to an interior surface of the housing.

According to a further set of embodiments, the central region A of the optical element 36 may have a circularly symmetric (for instance annular) shape or cross-section, and the peripheral region B may have a rectangular shape. The peripheral region may have a rectangular outer perimeter.

Figure 12:
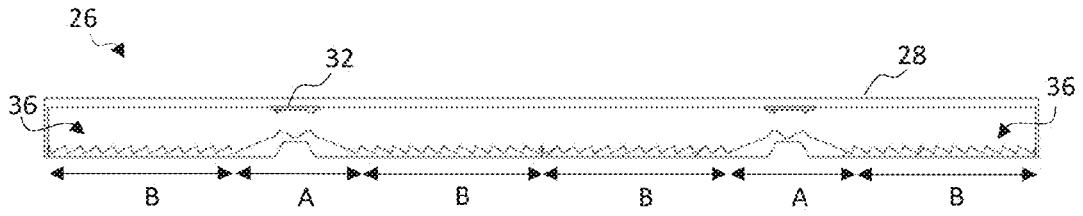
FIG. 12 shows a cross-sectional view of a second example luminaire in accordance with one or more embodiments of the invention.
Figure 13:
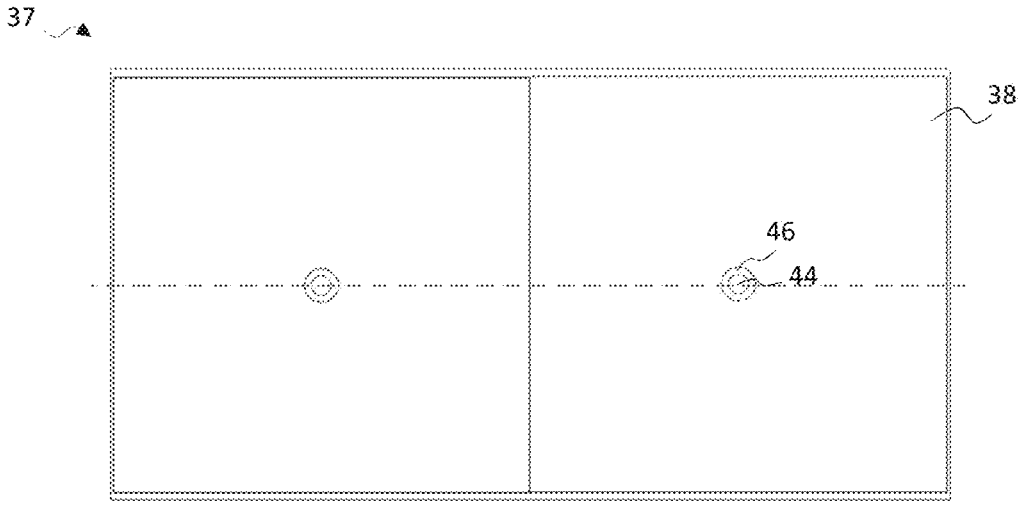
FIG. 13 shows an elevated view of an example optical element as incorporated within the second example luminaire.

An example of such an embodiment is illustrated schematically by FIGS. 12-15. The embodiment shown comprises two optical elements 36, each having a peripheral outer region B having a rectangular perimeter, and a central region A having a circularly symmetric shape or cross-section. The optical elements are joined as shown in FIG. 13 to form a combined optical plate structure 37 comprising two contiguously arranged rectangular optical elements, each comprising a central region having a circularly symmetric cross section.

Figure 14:
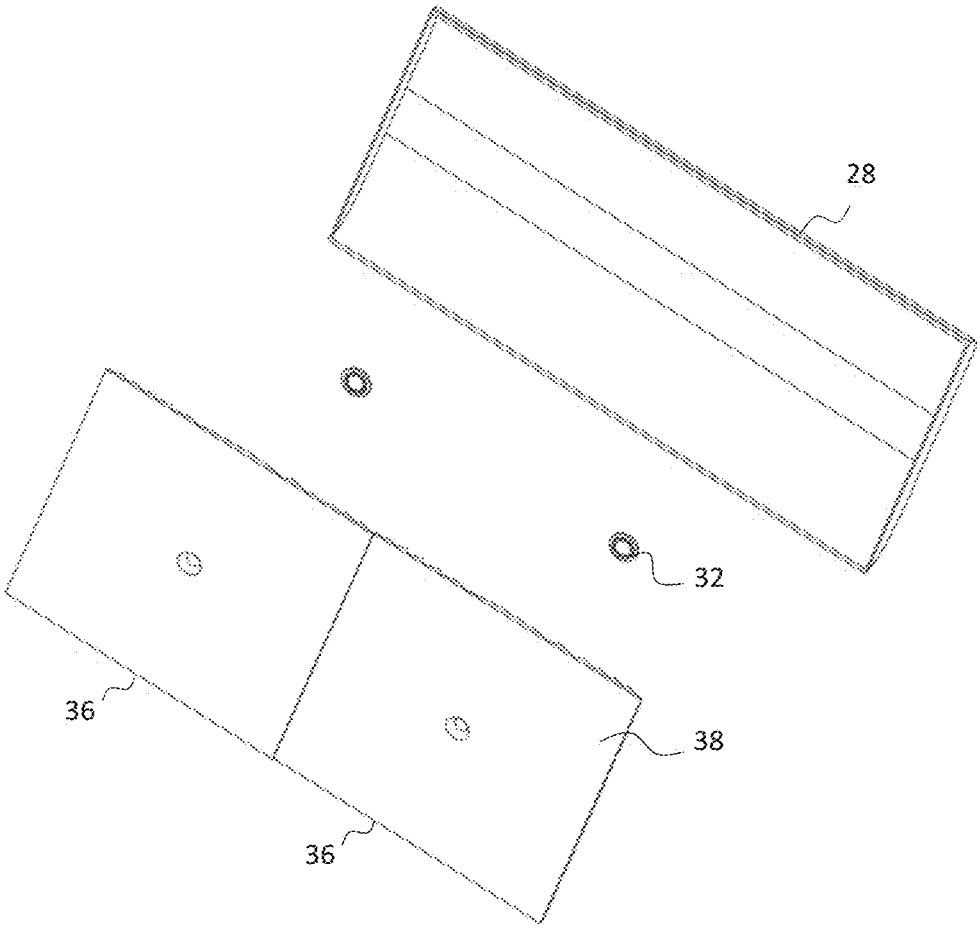
FIG. 14 shows an exploded view of the second example luminaire.

As shown in the exploded view provided by FIG. 14, the luminaire comprises two annular arrays of light sources 32, each arranged opposing one of the two circularly symmetric central regions of the combined optical plate 37. A rectangular outer housing 28 covers the optical plate and as shown in FIG. 12, delimits, in combination with the optical plate 37, an interior compartment within the luminaire.

Figure 15:
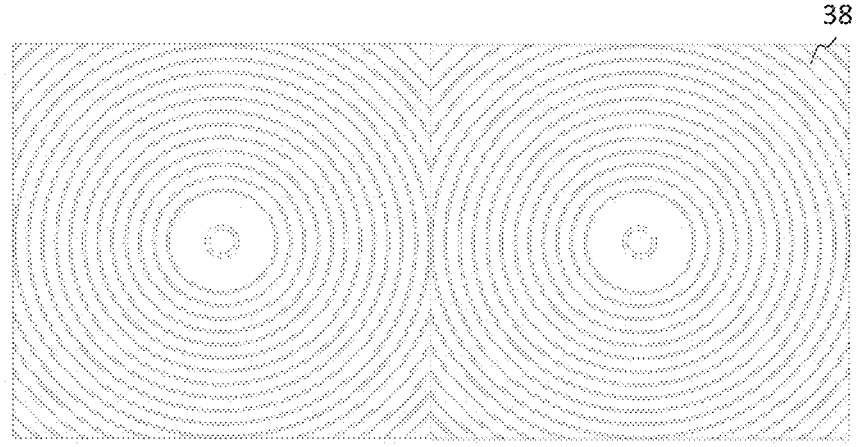
FIG. 15 depicts the optical structure of an optical element as comprised within the second example luminaire.

The optical structure of the optical plate 37 formed by the two combined optical elements 36 is shown in more detail in FIG. 15. As illustrated, the peripheral region 38 of each of the optical elements comprises an array of concentrically arranged circular ridges, each circular ridge being formed of an extended pyramidal micro-prism structure (similar to the structure illustrated in FIG. 7). The array of pyramidal ridges is configured to collimate incident light such that light incident at obtuse angles with the normal are reoriented into a more acute angular direction.

As can be seen from the example luminaire of FIGS. 12-15, the shape of the optical element outer perimeter may determine an overall shape of the final luminaire, since the optical element essentially forms a light exit window which seals the luminaire compartment. For this reason, a rectangular peripheral region B of the optical element 36 may be preferable in a number of applications, in particular where it is desired that the final luminaire have an overall shape which is rectangular. This may be the case for instance for ceiling lighting, especially recessed panel lighting, which is often required to fit within a modular ceiling panel system.

Figure 16:
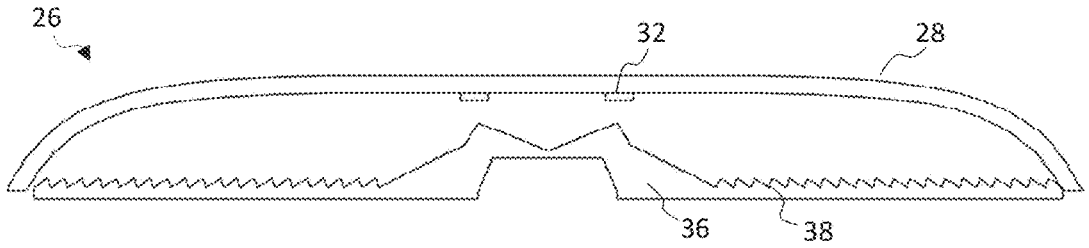
FIG. 16 shows a cross-sectional view of a third example luminaire in accordance with one or more embodiments of the invention.
Figure 17:
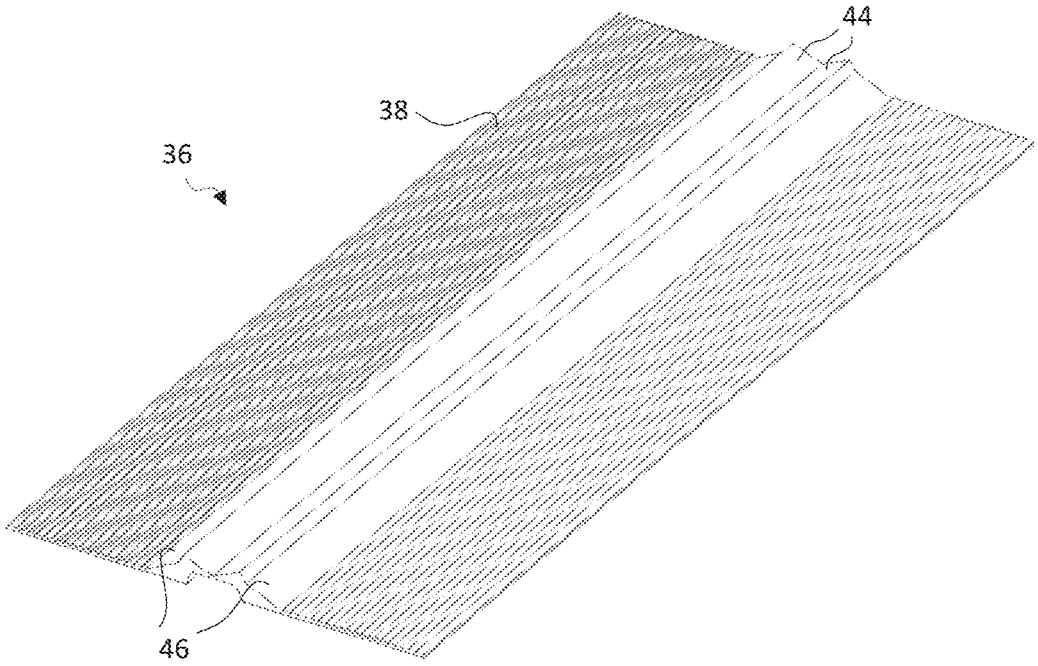
FIG. 17 shows a perspective view of an example optical element as comprised by the third example luminaire.
Figure 18:
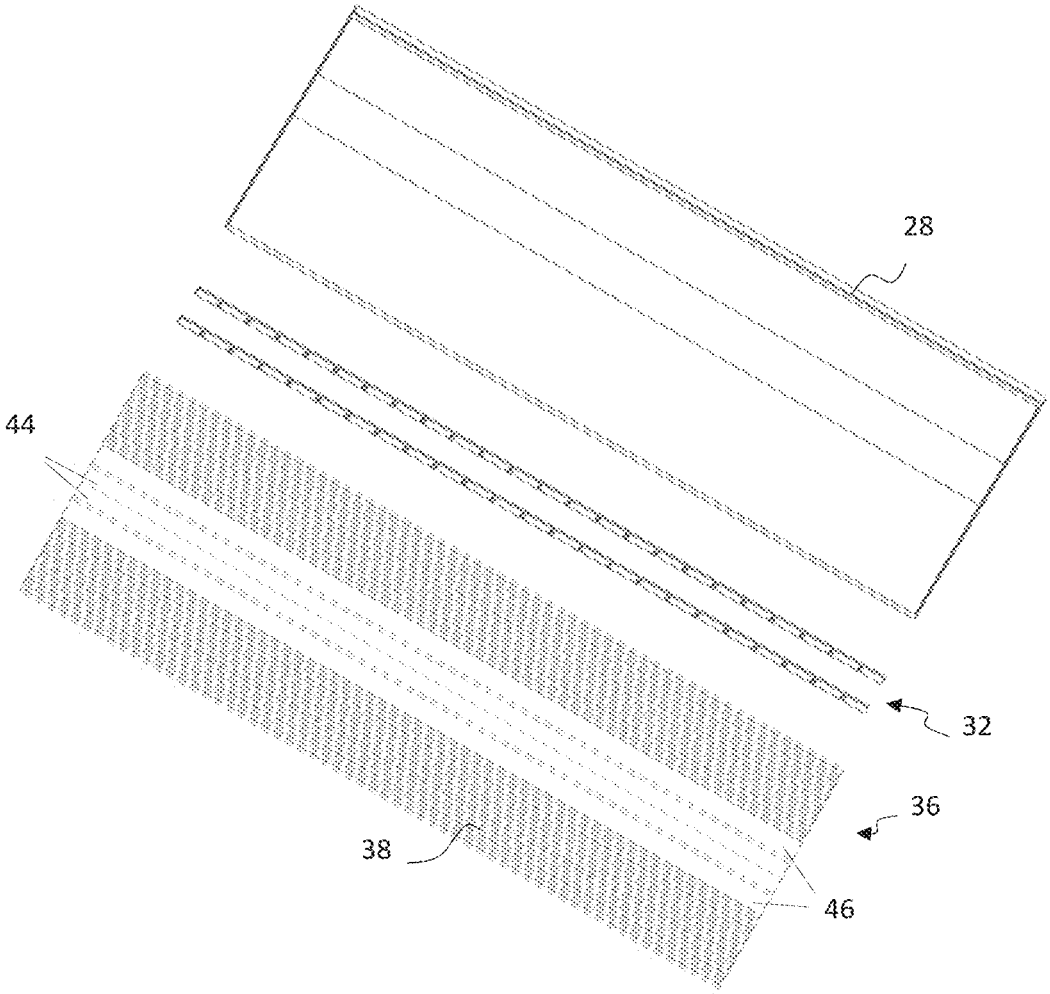
FIG. 18 shows an exploded view of the third example.

According to a further set of exemplary embodiments, the luminaire may comprise an optical element which includes an inner central region having an extended linear shape, and which is linearly symmetric about a centre line of the central transmissive surface portion 44. A first example of such a luminaire is illustrated by FIGS. 16-18. FIG. 16 shows a cross-sectional view of the example luminaire, FIG. 17 shows a perspective view of the optical element comprised by the luminaire, and FIG. 18 shows an exploded view of the example luminaire.

As shown in FIG. 17, the optical element 36 comprises an extended linear central region surrounded by an outer peripheral region formed of twin rectangular sections arranged along either side of the central region. The central transmissive surface portion 44 is formed of a pair of inwardly inclined surface sections meeting at a central line which defines a line of linear symmetry of the optical element. Surrounding the central transmissive surface portion is a tapered surface portion 46 formed of twin inclined surface sections, each extending between a respective linear boundary with the central transmissive surface portion to a boundary with a respective one of the twin rectangular sections of the peripheral region of the optical element.

As illustrated in FIG. 16, and also in the exploded view of FIG. 18, the luminaire comprises a light source arrangement 32 formed of two extended parallel rows of light sources, each arranged opposite to one of the two linear boundaries separating the central transmissive surface portion 44 and the tapered surface portion 46.

The peripheral transmissive surface portion 38 of the optical element 36 consists of a collimating plate having a micro-Fresnel structure, adapted to collect and collimate light emitted by the light sources and reflected from internal surfaces of the luminaire, and transmit the light out from the luminaire.

Figure 19:
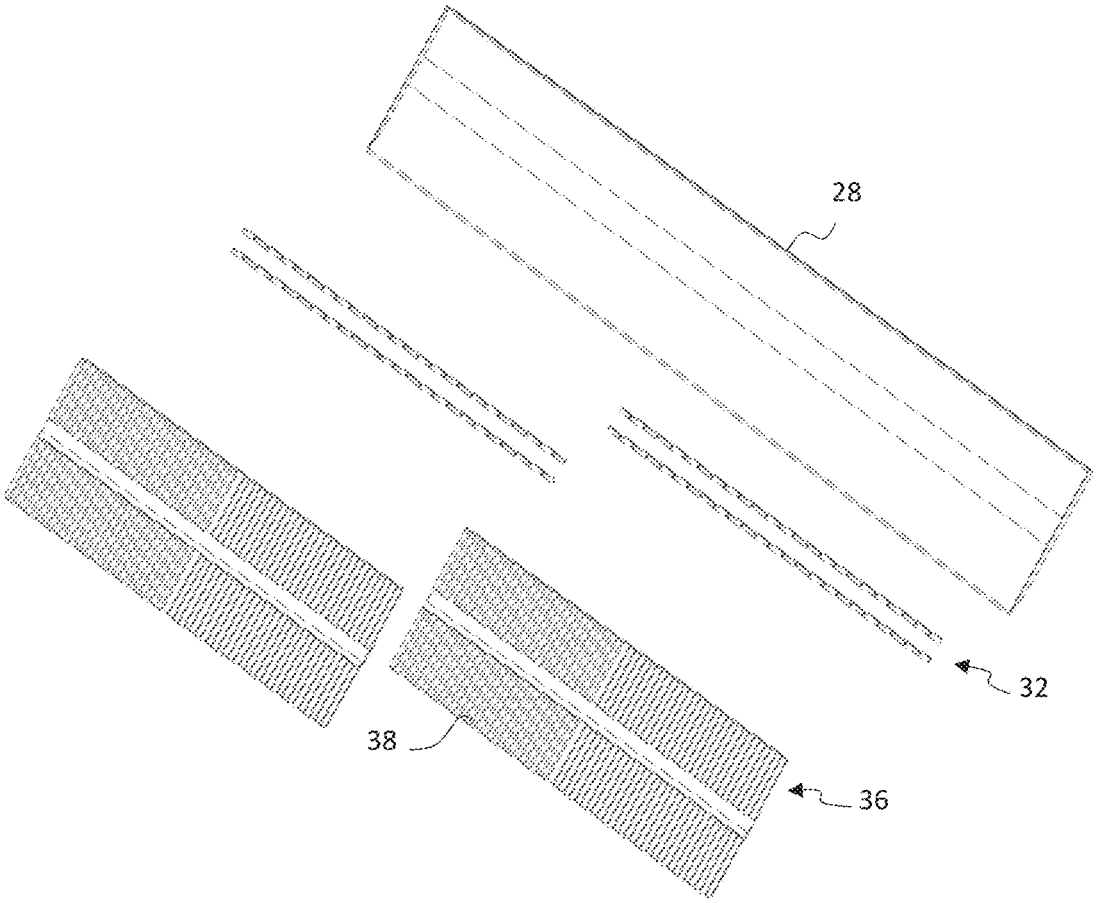
FIG. 19 shows an exploded view of a fourth example luminaire in accordance with one or more embodiments of the invention.

According to a further variation on the embodiment shown in FIGS. 16-18, a luminaire may be provided comprising a plurality of the optical elements 36 shown in relation to that embodiment. One example of such a variation is shown in FIG. 19, which comprises an assembly of two of the linear optical elements 36 of the embodiments of FIGS. 16-18, arranged end-to-end to form an extended optical plate structure. Arranged opposing each of the combined optical elements is a respective light source arrangement 32 comprising twin parallel rows of light sources. An extended housing structure 28 covers both optical elements and delimits, in combination with the optical elements, a compartment inside the luminaire.

Figure 20:
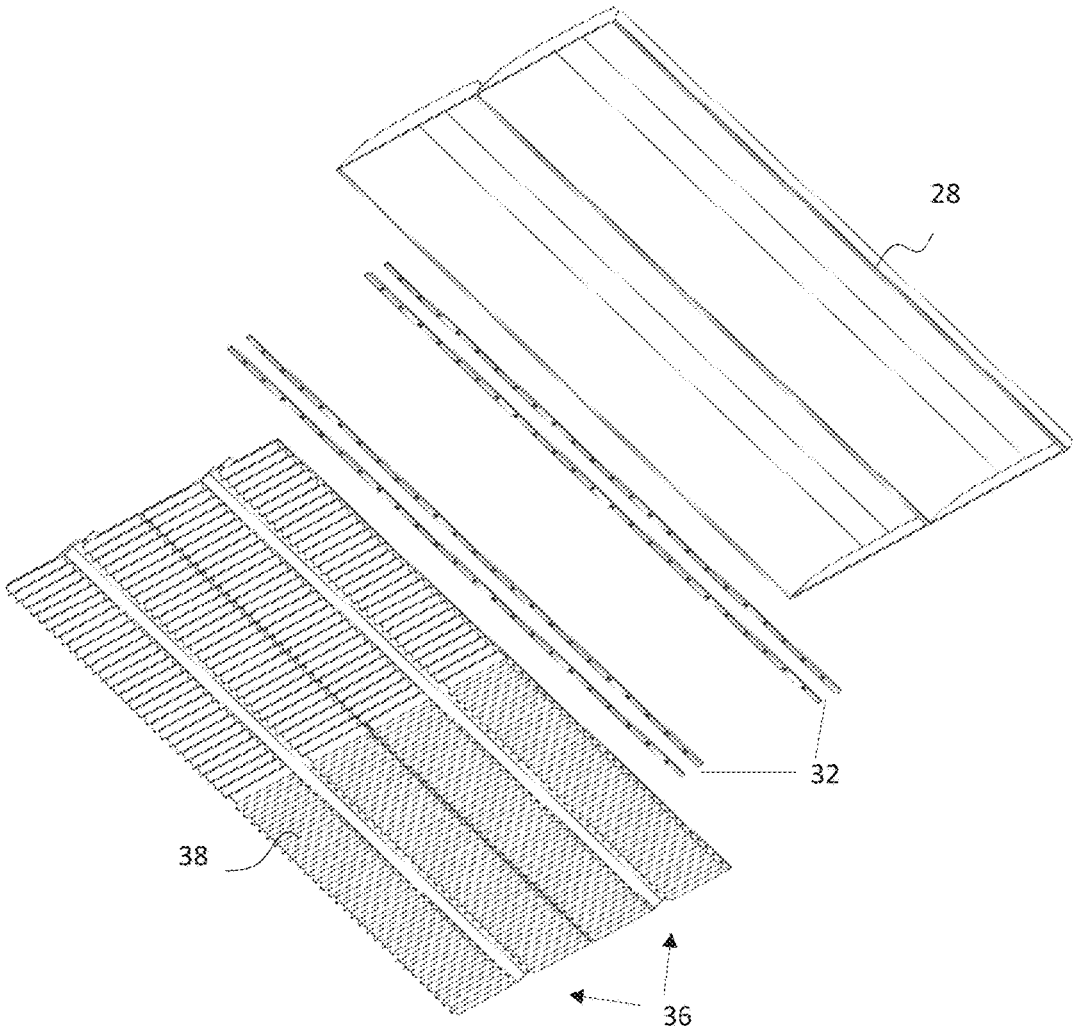
FIG. 20 shows an exploded view of a fifth example luminaire in accordance with one or more embodiments of the invention.

FIG. 20 shows a second variation on the embodiment of FIGS. 16-18, comprising four of the linear optical elements 36 provided by said embodiment. These are arranged in an array formation of two rows of two, each row being provided with a respective light source arrangement 32 formed of twin parallel lines of light sources. A housing structure 28 covers the whole assembly of four optical elements and two light source arrangements to delimit an internal compartment of the luminaire.

By way of non-limiting example, according to any embodiment of the invention, the tapered surface portion 46 of the optical element 36 may comprise a specularly reflective metal coating, being reflective across both sides.

Figure 21:
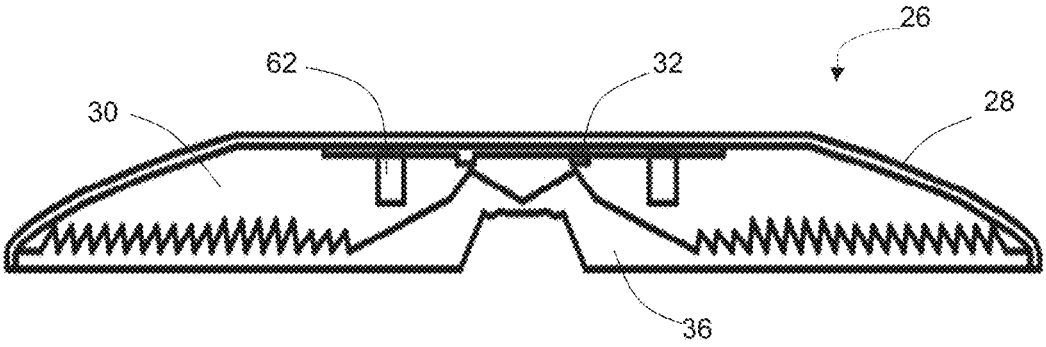
FIG. 21 shows a cross-sectional view of a sixth example luminaire in accordance with one or more embodiments of the invention.

In one embodiment of 'driver on board' (DOB) as shown in FIG. 21, driving components 62 are mounted on the same surface as the LED on the light source arrangement 32. The driving components 62 may lay both inside the light source circle (referring to FIG. 9) or outside the circle, and it's preferably to lay outside the light source circle for less influence to the light path and fully utilizing the space of internal compartment 30.

Figure 22:
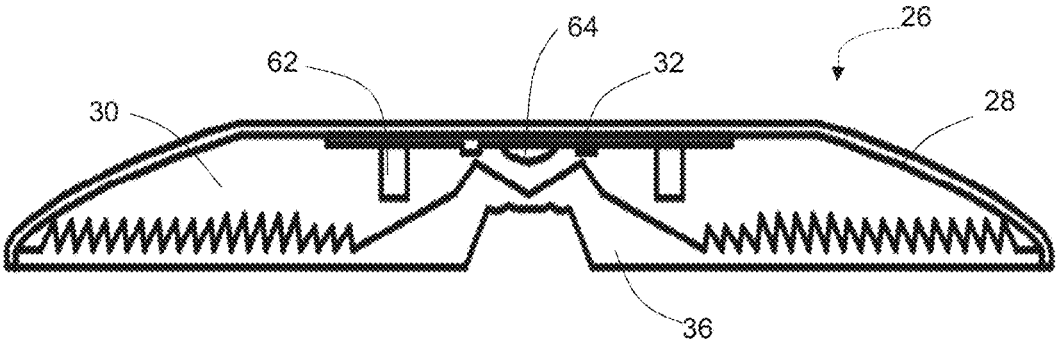
FIG. 22 shows a cross-sectional view of a seventh example luminaire in accordance with one or more embodiments of the invention.

FIG. 22 shows an embodiment of luminaire 26 with a sensor 64. The sensor 64 may lay on the centre of the light source arrangement 32, and the related control or driving components 62 may lay on the outside annular part. Because the optical element 36 is a polymer based lens, the signal of sensor 64 may be well caught. The dimension of luminaire 26 may keep unchanged as the non-sensor version. The sensor 64 may be a motion sensor or a presence sensor, utilizing infrared (IR), ultrasonic or microwave, radio frequency (RF) signal etc., for detecting.

Figure 23:
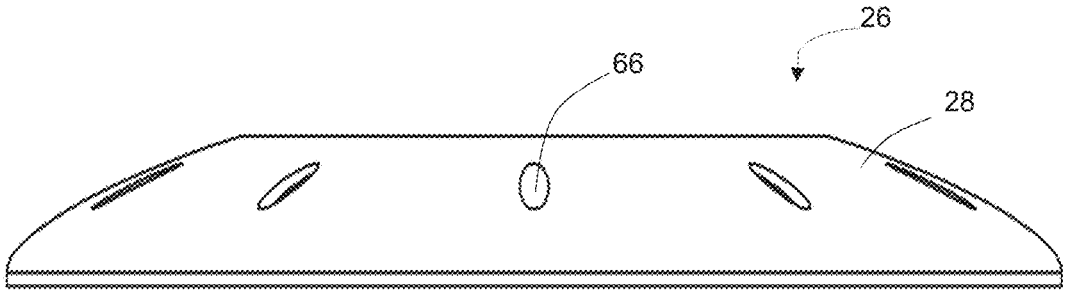
FIG. 23 shows a side view of an eighth example luminaire in accordance with one or more embodiments of the invention.
Figure 24:
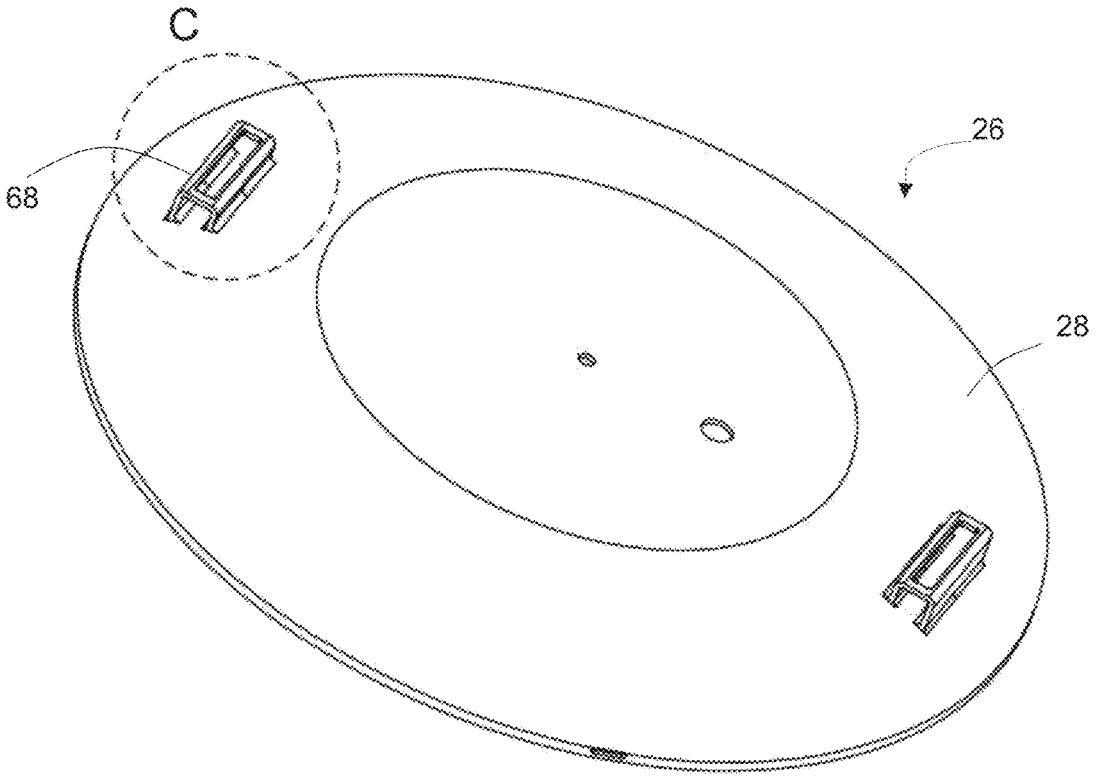
FIG. 24 shows a perspective view of a ninth example luminaire in accordance with one or more embodiments of the invention.
Figure 25:
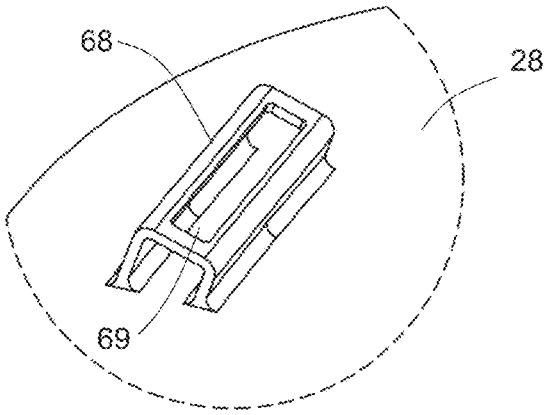
FIG. 25 shows a partial enlarged view (C) of the clamping portion of the example luminaire in FIG. 24.

FIG. 23 shows an embodiment of luminaire 26 with ambient light enhancement. In this version, there are several through holes 66 on the housing 28. Light may escape from these holes 66 to general or enhance ambient light, with respect to the main output from the optical element 36. Further, these holes 66 may be arranged in a pattern to get an aesthetic appearance. The holes 66 allows air flowing in/out of the internal compartment 30, and thus may bring additional thermal benefit.

Figure 26:
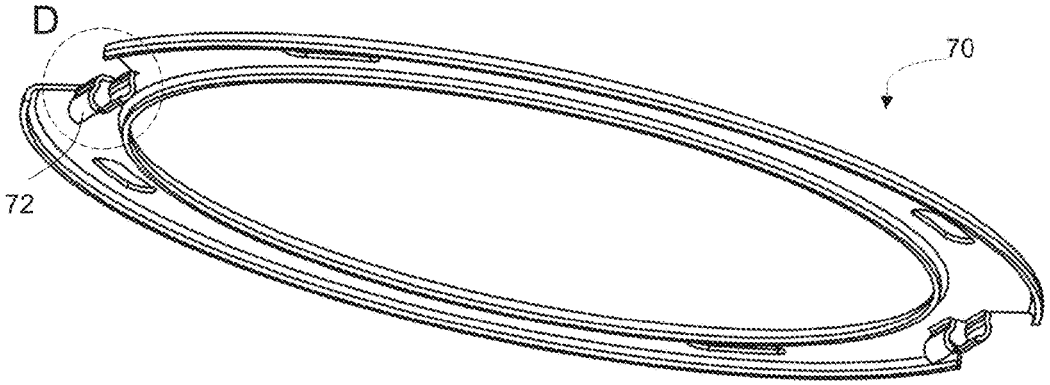
FIG. 26 shows a perspective view of a holder for the example luminaire in FIG. 24.
Figure 27:
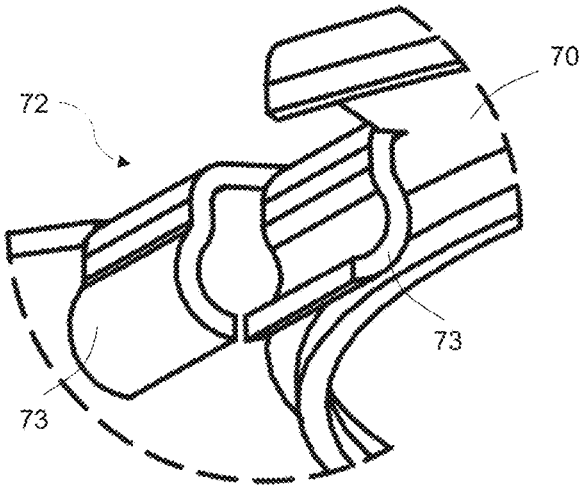
FIG. 27 shows a partial enlarged view (D) of the clamping portion of the holder in FIG. 26.

In a further embodiment, the luminaire 26 may be a replaceable one on a holder 70. There are fixture means between the luminaire 26 and the holder 70. An exemplar structure of fixture means is shown in FIGS. 24-27. The holder 70 is mounted on for instance on a ceiling surface. It's made of a piece of sheet metal, such as steel. There are two male clamps 72 which are bent portions from this same sheet metal, as shown in FIG. 26. Each male clamp 72 may comprises two spring fingers 73 protruding from the surface of ceiling, referring to the enlarged view of FIG. 27. See FIG. 24, two female clamps 68 are integrated on the corresponding position of the housing 28 of luminaire 26. Each female clamp 68 comprises a slot 69 as shown in the enlarged view of FIG. 25. By inserting the spring fingers 73 into the slots 69, the luminaire 26 can be mounted onto the holder 70 or removed therefrom easily.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A luminaire, comprising:

a housing including a compartment having a reflective inner surface and an optical element comprising:

a light entry surface arrangement facing the compartment and including a central transmissive surface portion separated from a peripheral transmissive surface portion by a tapered surface portion having opposing reflective surfaces and tapering outwardly towards a light exit surface arrangement including a central stepped profile stepping toward the compartment, the central stepped profile including a transmissive roof section facing the central transmissive surface portion and one or more tapered total internal reflection sidewall sections each facing a reflective surface of the tapered surface portion, the transmissive roof section having a smaller cross-section than the central transmissive surface portion; and a light source arrangement in the compartment arranged to emit a first fraction of light onto the central transmissive surface portion and a second fraction of light onto at least one of the reflective inner surface, the tapered surface portion and the peripheral transmissive surface portion.

2. A luminaire as claimed in claim 1, wherein the central transmissive surface portion of the optical element comprises one or more inclined surfaces meeting in a point facing the stepped profile.

3. A luminaire as claimed in claim 1, wherein the tapered surface portion of the optical element is concavely inflected, comprising adjoining inclined surface sections.

4. A luminaire as claimed in claim 3, wherein said adjoining inclined surface sections are of unequal length, such that a vertex of said inflection is located closer to a boundary with the central transmissive surface portion of the optical element than to a boundary with the peripheral transmissive surface portion.

5. A luminaire as claimed in claim 1, wherein said peripheral transmissive surface portion of the optical element comprises a collimating lens plate.

6. A luminaire as claimed in claim 5, wherein said collimating lens plate is a Fresnel plate.

7. A luminaire as claimed in claim 1, wherein a section of the reflective inner surface of the housing is bow-shaped.

8. A luminaire as claimed in claim 1, wherein the reflective inner surface is diffusively reflective.

9. A luminaire as claimed in claim 1, wherein the light exit surface arrangement has a total surface area which includes a surface area opposite the central transmissive surface portion and tapered surface portion of the light entry surface arrangement, and wherein the first fraction of light emitted onto the central transmissive surface portion corresponds to a proportion of a total luminous output of the light source arrangement equal to said surface area as a proportion of the total surface area.

10. A luminaire as claimed in claim 9, wherein the light source arrangement has a total light emitting area, and is positioned opposite to a boundary between the central transmissive surface portion and the tapered surface portion such that a first portion of said total light emitting area faces the central transmissive surface portion, said first portion corresponding to a fraction of the total light emitting area equal to said surface area opposite the central transmissive surface portion and tapered surface portion as a fraction of said total surface area.

11. A luminaire as claimed in claim 1, wherein the central transmissive surface portion and the tapered surface portion are separated by a circular boundary, and wherein the light source arrangement comprises an annular arrangement of light sources positioned opposite to said boundary.

12. A luminaire as claimed in claim 1, wherein the central transmissive surface portion and the tapered surface portion of the optical element are separated by a pair of parallel opposing linear boundaries, and wherein the light source arrangement comprises a plurality of rows of light sources.

13. A luminaire as claimed in claim 1, wherein the peripheral transmissive surface portion has a circular outer perimeter, or a rectangular outer perimeter.

14. A luminaire as claimed in claim 1, wherein the central transmissive surface portion is formed of an optical grade polymer material.

15. A luminaire as claimed in claim 1, wherein the opposing reflective surfaces of the tapered surface portion are formed by a specularly reflective metal coating.

* * * * *